United States Patent [19]

Lingl, Jr.

[11] 4,092,094

[45] May 30, 1978

[54] METHOD AND APPARATUS FOR THE CONTROLLED DISTRIBUTION OF POWDERED SOLID FUEL TO BURNING UNITS

[75] Inventor: Hans Lingl, Jr., Paris, Tenn.

[73] Assignee: Lingl Corporation, Paris, Tenn.

[21] Appl. No.: 772,238

[22] Filed: Feb. 25, 1977

[51] Int. Cl.[2] ..... F23K 3/02

[52] U.S. Cl. ..... 432/1; 110/104 R; 110/106; 432/20; 432/51; 236/1 A

[58] Field of Search ..... 110/101 R, 101 CF, 104 R, 110/105, 106; 432/20, 51, 58, 159, 53, 36, 22, 1; 236/15 BA, 15 BD, 1 A

[56] References Cited

U.S. PATENT DOCUMENTS

| | | | |
|---|---|---|---|
| 1,481,067 | 1/1924 | Pomeroy | 110/106 |
| 1,628,609 | 5/1927 | Newhouse | 110/106 |
| 1,708,505 | 4/1929 | Jackson | 110/104 R |
| 1,741,184 | 12/1929 | Denison | 110/104 R |
| 2,259,967 | 10/1941 | Vogel-Jorgensen | 110/106 |
| 2,427,903 | 9/1947 | Crites | 110/106 |
| 2,511,017 | 6/1950 | Sherban | 110/106 |
| 2,654,331 | 10/1953 | Mosshart | 110/104 R |
| 3,033,134 | 5/1962 | Hennecke | 110/104 R |
| 3,050,018 | 8/1962 | Pearson | 110/101 CF |

*Primary Examiner*—John J. Camby
*Assistant Examiner*—Henry C. Yuen
*Attorney, Agent, or Firm*—Cushman, Darby & Cushman

[57] ABSTRACT

Both method and apparatus are disclosed for controlling the distribution of powdered solid fuel to one or more burners. The powdered solid fuel is caused to pass downwardly through an air current passing from an air inlet to one or more outlet ports. The total rate at which fuel is distributed is controlled by the rate at which air is supplied to the air inlet. In addition, each outlet port is provided with an individual adjustment for controlling the relative rates at which fuel is supplied through the various individual outlet ports. The construction of the distributor is such that the system may be controlled to distribute fuel continuously or in successive controlled impulses while at the same time controlling both the total amount of distributed fuel as well as the relative amounts of fuel distributed in the various outlet lines to the burners. The preferred distribution apparatus utilizes only components which are stationary and motionless with respect to one another during normal operation so as to avoid the disadvantages otherwise caused by the interaction of the powdered solid fuel particles and moving apparatus components.

75 Claims, 4 Drawing Figures

METHOD AND APPARATUS FOR THE CONTROLLED DISTRIBUTION OF POWDERED SOLID FUEL TO BURNING UNITS

This invention generally relates to method and apparatus for the distribution of powdered solid fuel to one or more burners. It has particular application for burners used in the temperature controlled zones of kilns as used in the ceramic industry, e.g., brick curing kilns and the like, wherein the temperature profile of the plurality of burner pipes must be properly controlled so as to achieve desired firing effects.

While many kilns and other types of apparatus utilizing burners have, in the past, been fired with natural gas or other fuels, the owners and operators of such apparatus must now look with increasing frequency to alternate or substitute fuels in other than the convenient liquid or gaseous state. In particular, many such operators will find it advantageous or even necessary to find ways of using alternate fuel sources such as coal or other similar types of solid fuels.

Although the desirability of providing for the use of alternate powdered solid fuel (such as coal) has long been recognized, the earlier attempts to provide such flexibility having not been entirely successful. The lack of success is especially noticeable in applications such as a temperature controlled zone of a kiln as used in the ceramic industry. In such an environment, it is often necessary to control more than the gross temperature of the kiln. For example, one must provide for appropriate control of the temperature profile across a plurality of burners to achieve some of the desired ceramic firing effects within the temperature control zone of the kiln.

Although several firing and distributing systems for powdered coal are known, all of these prior systems have undesirable limitations when utilized to fire kilns which require controlled temperature distribution in the kiln tunnel, and, therefore, require adjustable supply to the individual burners without that control zone. For example, most prior attempts to distribute powdered coal to burners require mechanical equipment for such distribution and lack control over the fuel feeding rate to the individual burners relative to one another. Many of these prior systems have fuel feeding rates which are also overly sensitive to the grain size of the powdered coal and/or its moisture content, even when the coal is relatively dry.

For example, U.S. Pat. No. 1,741,184 uses a rotating bowl to distribute a coal-air mixture to different individual burner lines while one embodiment of U.S. Pat. No. 3,352,605 similarly shows a blower-type impeller utilized for the same purpose. These prior distribution units may provide an adequate means for the even distribution of a coal-air mixture to a total plurality or group of burners. However, such prior units do not permit adequate control and/or variation of the relative coal-air quantities being fed to the individual burners within the group. Furthermore, such earlier units have moving mechanical parts in direct contact with the coal-air mixture, thus necessitating specially sealed bearing units, constant maintenance and the expenditure of considerable additional energy.

Still another known prior type of system is used primarily for feeding individual burners. This individual distribution system sweeps the surface of powdered coal supply with an air stream created by a negative pressure differential, thereby entraining powdered coal within the air stream. This powdered coal-air mixture is then directed to a burner through a pipe with some control over the amount of coal thus fed to the burner achieved by opening or closing an air inlet provided over the slanted coal surface within a supply hopper and also controlling another air inlet in reverse proportion thereto at a location further downstream in the pipe. This approach, however, is overly sensitive with regard to the grain size of the coal as well as its humidity. Variation of either grain size or the humidity leads to significantly different amounts of coal being fed to the burner. Furthermore, this approach can only be used for continuous feeding of burners and does not permit impulse feeding.

Yet another prior system operates by blowing a coal-air mixture into a distributor unit which incorporates a mechanically operated, rotating distributor device for supplying a number of individual burners in sequence. Either one or several burners may actually be fed at the same time. However, this device does not permit one to feed all of the burners at the same time nor does it allow for adjustment of the relative amounts of fuel being fed to the individual burners. Since all of the burners cannot be fed at the same time, such an approach will not permit continuous firing of the burners. Furthermore, the moving mechanical equipment utilized to effect the coal distribution necessarily increases the maintenance and energy requirements for such a system.

Now, however, I have discovered a new type of apparatus for controlled distribution of powdered solid fuel to one or more burners which is particularly adapted for use in the temperature control zone of a kiln or the like. It will also be appreciated that this new apparatus may find applications elsewhere as well.

The new method and apparatus of my invention permits controlled distribution of powdered solid fuel to one or more burners without the powdered coal coming into contact with moving mechanical parts. Furthermore, in this invention the powdered coal is positively fed to the burners because the coal is blown into the burner lines rather than being picked up by air currents sweeping over the surface of a pile of powdered coal or the like. Furthermore, this invention provides systematic control over the burning process in every desirable way since it permits the burners to be either fired continuously or impulsively. In addition, this invention permits accurate control over the rate at which coal is supplied to a total group of burners while at the same time permitting adjustment of the relative rate at which fuel is supplied to the individual burners and therefore controlling the temperatures produced by the individual burners and thus permitting one to control the temperature profile of a group of burners.

In the preferred exemplary embodiment, the distribution mechanism provides for the controlled feeding of powdered solid fuel to one or more burner pipes within the temperature control zone of a kiln by using the same source of compressed air for transporting the coal pneumatically to the distributor units as well as for the actual distribution of the coal to the various burner pipes in such a way that both the cumulative burning capacity of the group of burners as well as the relative capacity of the individual burners can be varied. In addition, the burners can be fired continuously or by successive impulses.

An alternate source of compressed air may be employed to supply the compressed air for the actual distribution of the coal to the various burner pipes as may be appreciated.

In this presently preferred exemplary embodiment, the overall unit includes a mechanism for drying lumps of of coal using the hot exhaust gases from the kiln, grinding the lumped coal into powdered form having desired grain sizes and thereafter metering the powdered coal into a pneumatic conveyor line supplied with compressed air for transport to individual distributing units disposed on the top of a tunnel kiln in the vicinity of burners disposed within the roof or the side walls of the kiln. At the individual distributor site, a separating means is employed for separating the entrained powdered coal from the air used for pneumatically transporting it thereto. This separation occurs above an intermediate storage means into which the separated powdered coal is supplied. The separated compressed air is then directed so as to power the actual distributor unit which is mounted beneath the intermediate storage means.

In this preferred exemplary embodiment, the distributor itself is formed from an annular housing having output ports spaced therearound with a fuel inlet port formed as a central opening on the top side of the housing and adapted for connection to receive a supply of the powdered solid fuel from the intermediate storage means. A stop plate of approximately the same dimensions as the central opening and registered therewith is suspended below the central opening at a height intermediate the output ports such that the powdered solid fuel spills over the edges of the stop plate into the vicinity of the output ports. An air inlet port is also provided as an opening in the bottom side of the housing under the stop plate and connected to the source of compressed air such that the incoming powdered coal is caused to pass downwardly directly into the path of an air current between the air inlet and the outlet ports. The outlet ports are preferably also supplied with a controllable amount of auxiliary compressed air and thereby determining the relative amounts of coal supplied to the individual output ports of a given distributor. By controlling the amount of compressed air passing to the air inlet of the distributor, the distributor may be turned on and off and/or controlled to intermediate modes of operation for supplying controlled rates of powdered coal to the plurality of outlet ports in a given distributor.

Accordingly, the preferred exemplary embodiment of this invention provides both apparatus and method for utilizing the air from a pneumatic conveyor (in which the powdered fuel is transported from a mill to a storage silo) to also power the individual distributors used for distributing fuel to the different burners of a given group of burners without ever causing the powdered coal particles to come into contact with moving mechanical equipment and while still permitting the desired control over both the rate at which fuel is supplied to a given group of burners as well as the rate of control over the relative rates at which the individual burners of that group are supplied with fuel. Furthermore, the distributor does not become clogged when the air supply is cut off so that the distributor may be turned on and off to provide impulse firing of the burners, if desired, or may be continuously operated for continuous firing of the burners as may be required to achieve the desired temperature distribution within a kiln or other apparatus housing the burners.

This preferred exemplary embodiment of the invention thus permits temperature control of burner groups by both "on-off" control or "high-low" control as may be required by particular kiln systems or other apparatus employing burners. Furthermore, this invention will permit the use of powdered solid fuel having a wide range of grain sizes and humidity content. In fact, in the preferred embodiments, it should be possible to utilize powdered solid fuel having any grain size and/or humidity content which will still permits the pneumatic transport of the powdered fuel through the conduits of the system.

These and other features and advantages of this invention will become more clearly apparent from the following detailed description taken in conjunction with the accompanying drawings, of which:

Figure 1:
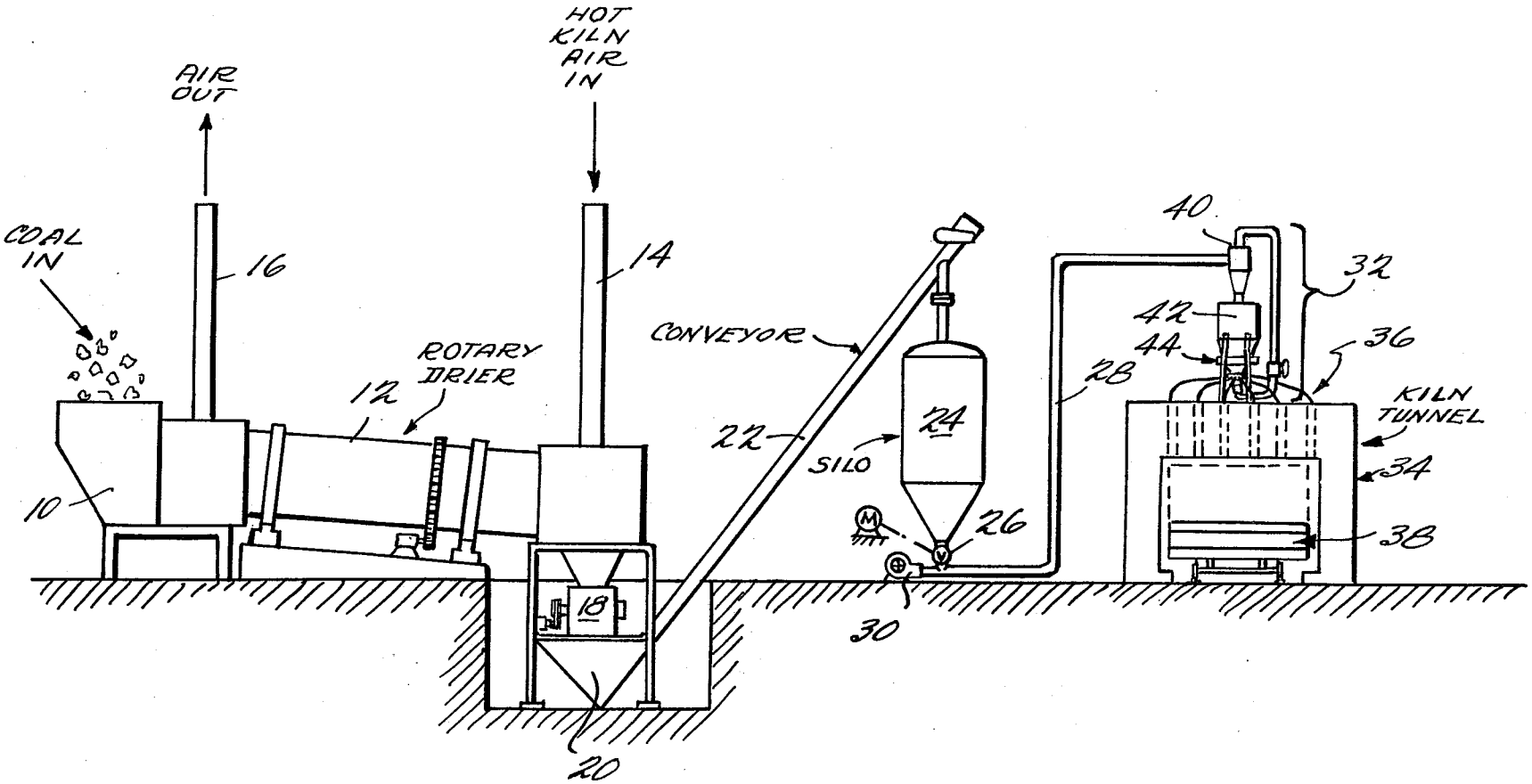
FIG. 1 is a schematic depiction of a complete kiln system utilizing my invention and showing same from a point where lump coal or solid fuel is provided to the point where a group of kiln burners is controllably supplied with powdered coal according to this invention.

A complete, presently preferred, exemplary embodiment of the solid fuel firing system is shown in FIG. 1. Here, lump unground coal is dumped into a hopper 10 which feeds such lump coal into a rotary dryer 12. The drying process is assisted by hot kiln exhaust gases fed into the rotary dryer via conduit 14 and exhausted therefrom through conduit 16. At the exit end of rotary dryer 12, the dried lump coal falls into a grinding mill 18 which may be, for example, a hammer mill using screens for grain size control. After grinding into powdered form, the coal falls into a receiving hopper 20 from which a conventional screw conveyor 22 or other conventional conveyance means transports the powdered coal to a storage silo 24.

A cellular wheel feeder 26 or other conventional controlled feed means (e.g., controllable such as by turning an electric motor on and off or the like) meters and feeds the powdered coal from the silo 24 into a pneumatic supply line 28 where the powdered coal is mixed with compressed air from the blower 30 and conveyed to one or more distributing units 32 disposed on top of a tunnel kiln 34. As will be appreciated, in other applications, the distributing units 32 would be mounted in conjunction with other apparatus employing burners. However, in the preferred exemplary embodiment of FIG. 1, the distributing unit 32 is disposed on top of the tunnel kiln 34 in the proximity of individual groups of burners 36 which are to be supplied with coal.

Tunnel kiln 34 is elongated and uncured ceramic products such as bricks are normally loaded in so-called "hacks" onto kiln cars 38 and passed longitudinally through the tunnel kiln. To achieve the desired curing of the ceramic product, it is often important to not only control the average temperature at various places within the kiln but also to control the temperature profile produced by a group of burners such as 36. As will now be explained in more detail, the distributor unit 32 provides the desired distribution of powdered coal in such a manner that it is controllable in every desirable way so as to achieve the desired firing effects within the tunnel kiln 34. That is, the burners 36 can be fired continuously or impulsively while, at the same time, the total amount of coal supplied to the burners 36 as a function of time is controllable as is the relative amounts of coal supplied to the individual burners of the group 36 so as to achieve control over the temperature profile produced thereby within the tunnel kiln 34. In addition, the distributing unit 32 achieves positive feed operation by passing the powdered coal directly into the path of a moving stream of air and also achieves the desired controllable distribution to the individual burners without the incorporation of moving parts which come into contact with the powdered coal particles.

Figure 2:
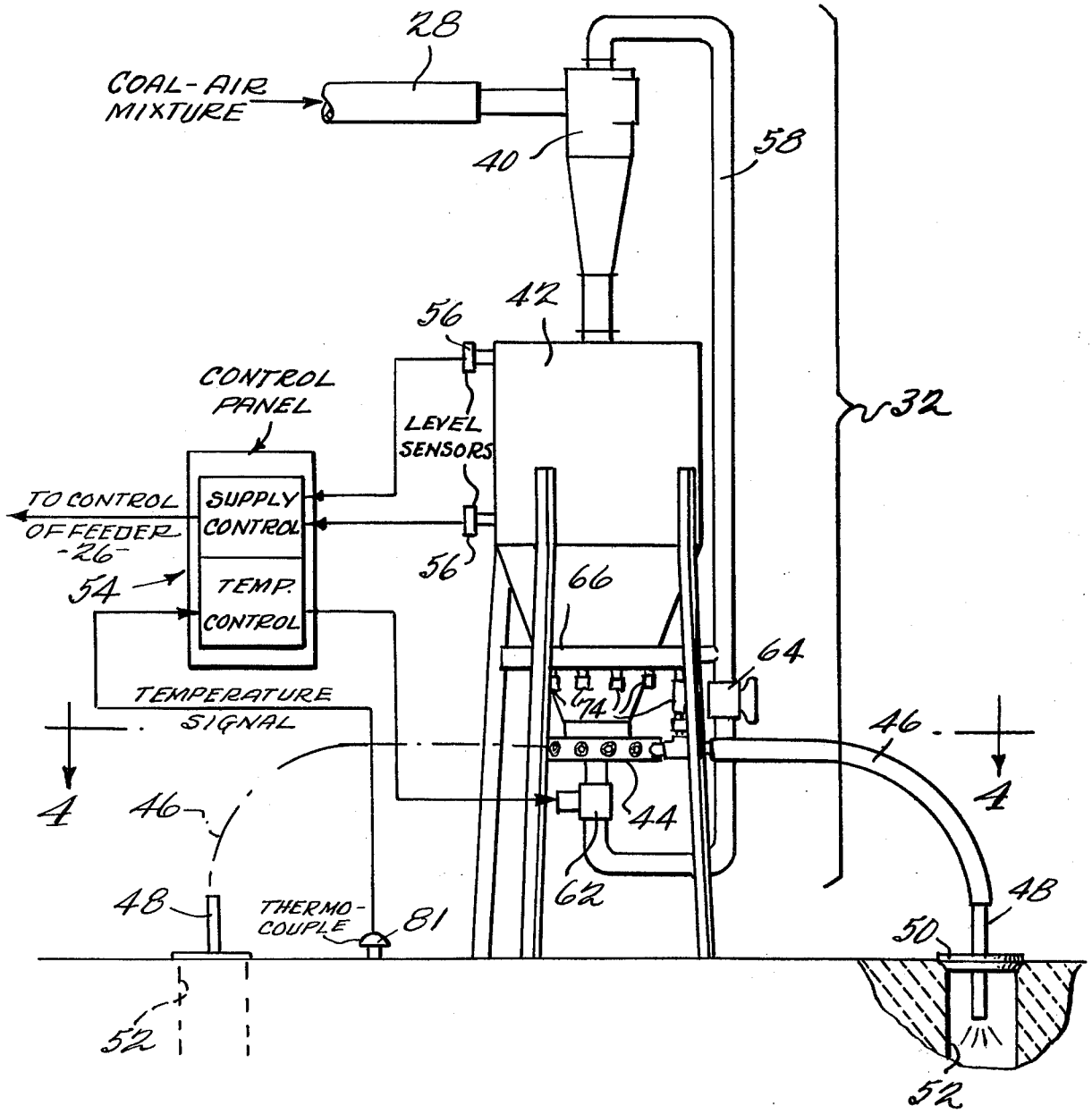
FIG. 2 is a more detailed side view of the apparatus mounted above the kiln in FIG. 1.

The presently preferred exemplary embodiment for the distributor unit 32 is shown in more detail at FIG. 2. Here, the incoming pneumatically conveyed powdered coal and compressed air mixture in conduit 28 is fed into a precipitator 40 or other form of conventional separation means for separating the conveyed powdered coal from the compressed air carrier. For example, the precipitator 40 may be a cyclone as commercially available for the separation of dust from gases.

As seen in FIG. 2, the precipitator 40 is mounted on top of a small storage container 42 and the separated powdered coal is dropped from the precipitator 40 thereinto. From storage container 42, the powdered coal is gravity fed into distributor 44 where the coal is controllably fed to the individual burner supply lines 46 for supplying burner pipes 48 disposed within lid structures 50 adapted for mounting within openings 52 of the kiln roof or kiln wall.

As schematically shown in FIG. 2, a control panel 54 is provided for controlling both the supply of powdered coal to the storage container 42 and for controlling the supply of powdered coal to the burner pipes 48, thereby controlling the temperature within the kiln. For example, level sensors 56 are provided at predetermined levels within the storage container 42 for detecting minimum and maximum amounts of powdered coal therewithin. This information is supplied to the supply control portion of control panel 54 and results in an electrical or other control signal for control of the feed mechanism 26 metering powdered coal into the pneumatic conveyor line. Thus, if the quantity of coal fed into the supply line 28 by the cellular wheel feeder 26 is greater than the quantity of coal being used by the firing system during the same period, the coal feed via feeder 26 to the precipitator 40 is interrupted during "off" periods of temperature control and/or when the maximum level sensor 56 is activated. As will be explained below, "off" periods of temperature control may cause reduced air flow in the pneumatic conveyor line 28 in the present preferred exemplary embodiment. Accordingly, in such cases, a time delay relay is incorporated within the control panel 54 so as to stop the cellular wheel feeder 26 a sufficient time before turning "off" the burner group to empty the conduit 28 of coal before reducing the air flow therein and thus preventing undesirable "fall-out" of the powdered coal within the conduit 28 because of such reduced air flow. If, in certain installations, it is desired to continue feeding coal to the precipitator 40 even during "off" periods of temperature control, then the exemplary embodiment could be modified so as to vent the separated air from the precipitator 40 during such periods, thus maintaining air flow within the conduit 28 and, accordingly, maintaining its coal carrying capacity during such "off" temperature control periods.

As shown in FIG. 2, the preferred embodiment will maintain at least a minimum level of coal within the storage container 42 sufficient to prevent any substantial flow of air backwardly (i.e., upwardly) from the distributor 44 through the storage container 42 and into the precipitator 40. In other words, so long as this minimum level of powdered coal is maintained within the storage container 42 an "air lock" is maintained between the precipitator 40 and the distributor 44 as is desired in the exemplary embodiment.

The compressed air, after separation from the powdered coal in precipitator 40, is conveyed via conduit 58 downwardly to supply compressed air to the distributor 44.

Figure 3:
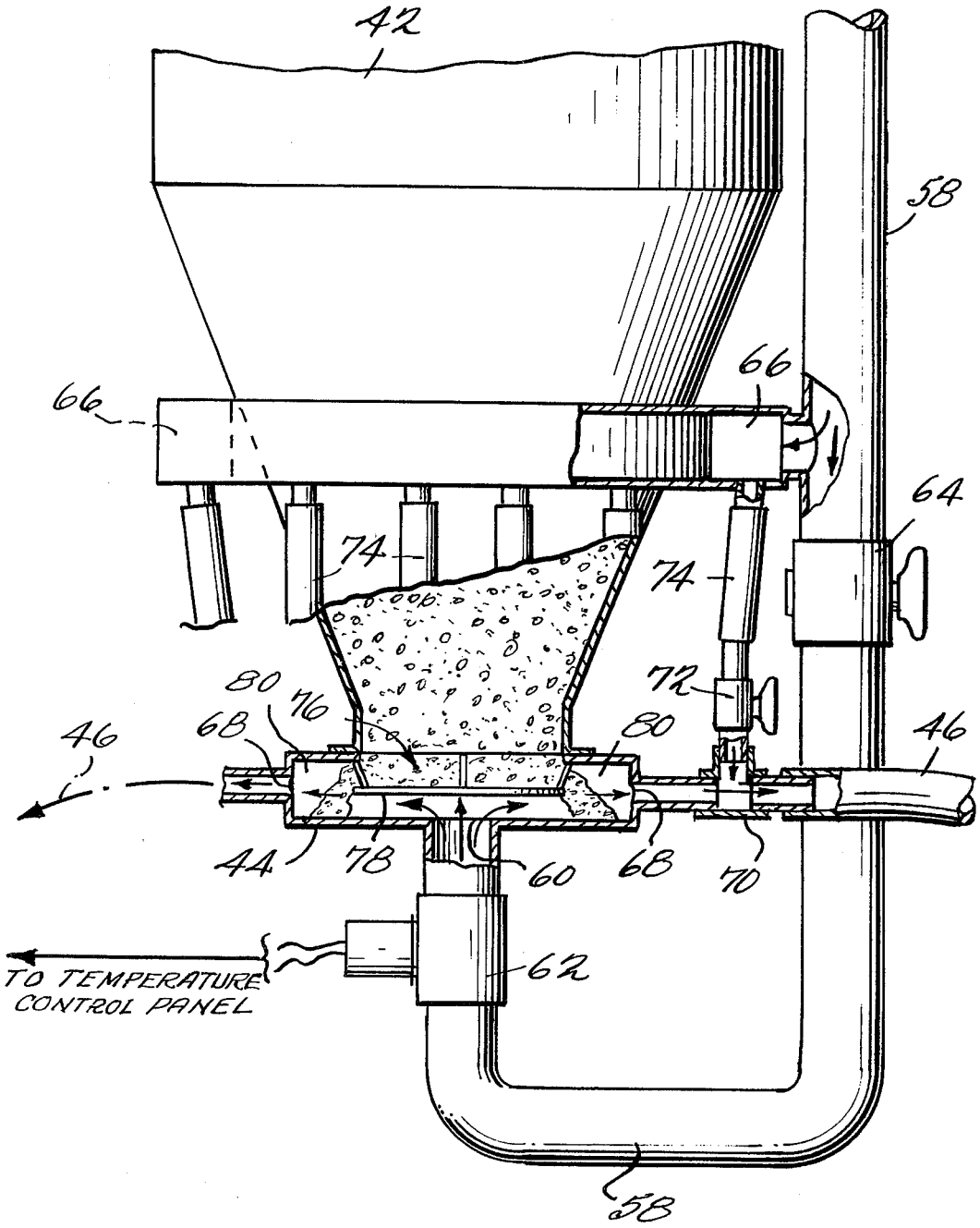
FIG. 3 is a still more detailed and partially cut away side view of a preferred exemplary embodiment of the distributor construction, air supply piping and controls, etc., shown in FIG. 2.

As shown in yet more detail at FIG. 3, the compressed air supply via conduit 58 is fed into the distributor 44 through an air inlet 60 at the lower side of the distribution 44 through a solenoid or other controllable valve 62 and a serially connected manually controllable valve 64. In addition, a supply of compressed air is also fed into a manifold 66 from which it is supplied in individually controllable quantities to each of the radially disposed plurality of outlet ports 68 through T connections 70, manually controllable valves 72 and conduits 74.

In addition to the air inlet 60 and plural radially disposed outlets 68, the distributor 44 has a fuel inlet 76 comprising a centrally located aperture.

Thus, in this preferred exemplary embodiment, the distributor 40 comprises a short cylindrical container having radially disposed openings or outlets 68 spaced around the cylindrical wall for feeding the individual burner supply lines 46. The distributor 44 is bolted with its fuel inlet 76 adjacent the bottom mouth of the storage container or silo 42.

As also seen in FIG. 3, the preferred exemplary embodiment includes a stop plate or disc of approximately the same diameter as the fuel inlet 76 suspended therebelow at a location approximately in the middle of the distributor 44 on an approximate level with the center of the outlet openings 68 to the burners. Thus, powdered coal gravity fed from the storage container 42 through the fuel inlet 76 of the distributor 44 is stopped by the disc 78 and, caused by gravity forces, to spill over the rim or periphery of disc 78 so as to leave an air space under the disc 78 and between the coal and the cylindrical wall of the distributor 44 having the outlet opening 68 therein.

Accordingly, when compressed air is fed into the air inlet 60 of distributor 44, it sets up air streams or currents therefrom into the plural radially disposed outlets 68. Since the powdered coal is being gravity fed downwardly and directly into the path of this air stream, such coal is positively forced by such air stream into the spaces 80 in the vicinity of outlet opening 68 and then discharged into the openings 68 and on through connecting lines 46 to the individual burners.

The rate at which coal is transferred from the distributor to the whole group of burners is controlled by the rate at which air is admitted into the air inlet 60 of distributor 44. This total or accumulative control over the group of burners 36 is provided by both the manual valve 64 and the automatically controlled solenoid valve 62 within the air line supply conduit 58. This automatic solenoid controlled valve 62 is actuated by the temperature control portion of panel 54 in response to temperature control signals received from thermocouple 81 which is disposed in the kiln tunnel. When the desired temperature is attained within the kiln tunnel, the temperature control panel 54 actuates valve 62 so as to shut off or reduce the air supply through air inlet 60 of distributor 44, thus shutting off or reducing the supply of powdered coal to the individual burners.

So as to improve the temperature distribution in the kiln tunnel, for example of a top fired kiln, provisions may also be made for firing the burners impulsively thus allowing the granulated fuel which is introduced into the burners on any given impulse to burn out completely before the next impluse supplying a new quantity of fuel is introduced thereto. This may be achieved, for example, quite independently of the temperature control system by simply incorporating a system of time delay relays or even a cam operated switch controller within the control panel 54 for automatically opening and closing the solenoid valve 62 in adjustable short intervals so that compressed air is fed into the air inlet 60 of distributor 44 in controlled impulses for impulse firing rather than continuous firing.

As explained previously, the rate at which coal is supplied to the total group of burners 36 is controlled by the rate at which air is supplied to air inlet 60. Control over the relative distribution of such quantities of coal between the various outlet ports 68 is controlled by controlling the amount of auxiliary air supplied from manifold 66 and the individual conduits 74 and control valves 72 connected therefrom to each of the several individual output lines 46. For example, through the T fitting 70 in supply line 46, air can be fed from the manifold 66 through the air line 74 and manually adjustable valve 72 into each individual burner line 46.

By passing more auxiliary air from the manifold into a given burner line, its internal air pressure is increased relative to the air pressure existing in other individual burner lines, thus reducing the quantity of coal passing through its respectively corresponding outlet port 68 and onto its respectively corresponding burner. Conversely, by decreasing the amount of auxiliary air supplied to a given burner line compared to that supplied to other lines, the relative quantity or rate at which coal is supplied through that particular burner line is increased.

Thus, by controlling the individual control valves 72, one can control the relative quantities of coal being fed to the individual burners of the group 36 while the total quantity of such coal being fed to the whole group of burners is controlled by controlling the air at inlet 60 via valves 62, 64. In effect, be feeding more or less compressed air from manifold 66 into the T fittings 70, the impedance of the burner lines 46 is controlled and, with this, the capacity of lines 46 to transport coal from the distributor is controlled so that the distribution of the fuel supply between the various individual burners can be adjusted. Alternate conventional means for individually controlling the coal carrying capacity of the lines 46 and/or means for individually controlling the relative quantities of coal admitted thereinto might also be employed as will be appreciated.

Figure 4:
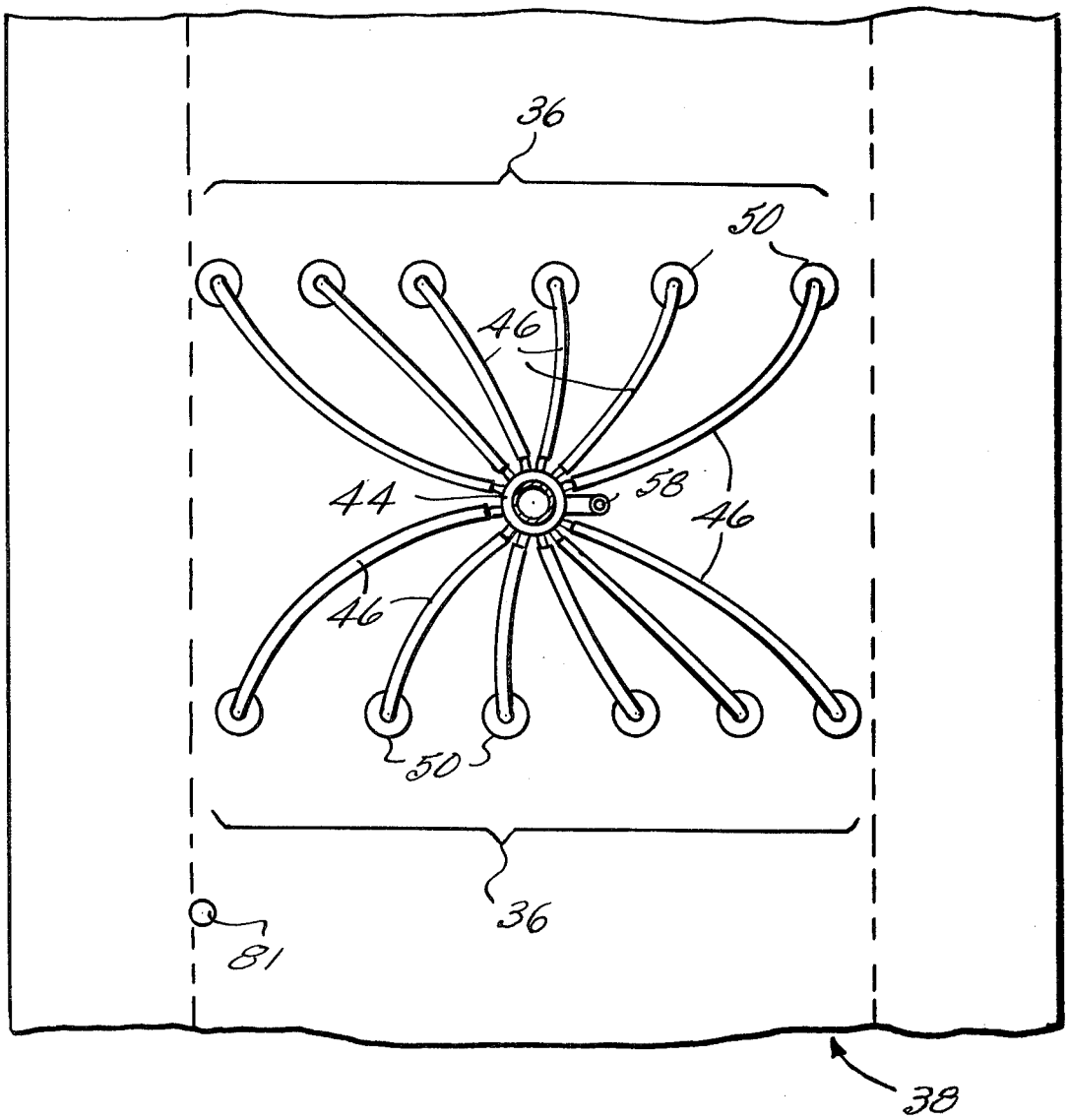
FIG. 4 is a schematic plan view of a section of kiln roof shown in FIG. 1.

The elevational view shown in FIG. 4 reveals the disposition of a typical set of burners in the roof of a tunnel kiln as supplied by one of the distributor units 32 previously described.

Accordingly, in the preferred exemplary embodiment just described, powdered fuel such as coal is distributed in a controllable manner to the individual burners of a temperature control zone in a tunnel kiln. A coal-air mixture is fed into a precipitator mounted on an intermediate silo or storage container of a coal distributing unit. The precipitator separates the coal from the air and provides the separated air as a supply of compressed air into the distributor for controlling the ultimate supply of the coal-air mixture to individual burner lines. The same source of compressed air is used for supplying a manifold having controllable individual connections to each burner line for providing relative quantity control between the various burner lines.

The pneumatic supply of coal to the distributor unit in this exemplary embodiment is controlled so as to maintain the on-hand supply within the distributor between minimum and maximum levels thereby maintaining an airlock between the precipitator and the distributor unit itself. The pneumatic feeding of coal to the precipitator interacts with the overall temperature control in this preferred embodiment so as to insure that the pneumatic conveyor is cleared of coal before its coal carrying capacity is reduced. Such reduction might occur by turning off the distributor units in response to a temperature control signal which, in the exemplary embodiment, would reduce the flow of air within the pneumatic conveyor.

The coal from the intermediate storage container is fed by gravity into a distributor from the mouth of the storage container. The distributor includes a stop disc suspended in the path of the gravity feed so as to partially impede the flow of powdered fuel therepast into the distributor while letting the powdered fuel spill over the rim or periphery of the stop disc. A supply of compressed air blown into the distributor from underneath the stop disc positively entrains and blows the powdered fuel with plural air streams into the plural outlets of the distributor radially diposed thereabout and on into the corresponding burner supply lines.

A manually controllable valve and an automatically controlled solenoid valve are provided for controlling the air fed into the air inlet of the distributor, thereby adjusting the total amount of air blown into the distributor and, with this, the total amount of coal distributed as a function of time. Individual auxiliary air supply is controlled to the various burner lines for controlling the relative distribution of this total quantity of coal between the various burners of the supplied group. When a desired temperature is reached, the air supply is stopped or reduced, thus stopping the reducing supply of coal to the burners. In addition, the distributor can be turned on and off, thus permitting impulse control so as to allow for firing of the burners at periodic successive intervals for improving temperature distribution within the kiln.

While only one preferred exemplary embodiment of this invention has been described in detail above, those skilled in the art will recognize that many modifications may be made in this exemplary embodiment without materially departing from the novel and advantageous features of this invention. Accordingly, all such modifications are intended to be included within the scope of the invention as defined by the following appended claims.

What is claimed is:

1. Apparatus for controlled distribution of powdered solid fuel to a burner, said apparatus comprising:

distribution means having a fuel inlet connected to receive a supply of powdered solid fuel from above;

said distribution means having a stop plate disposed below said fuel inlet for temporarily stopping the flow of said powdered solid fuel and permitting said fuel to spill over the edge of said stop plate;

said distribution means having an air inlet connected for receiving a supply of compressed air;

said distribution means having an outlet disposed adjacent the area where fuel spills over the edge of said stop plate and adapted for connection to said burner;

said distribution means being constructed so as to define an air space between said spilled fuel and said outlet;

said distribution means, said fuel inlet, said stop plate, said air inlet and said outlet being constructed relative to one another so as to cause the powdered solid fuel entering through the fuel inlet to pass downwardly and spill over the edge of said stop plate into the vicinity of said air space where it mixes with an air current and is positively blown into and through said outlet at a rate dependent upon the rate at which compressed air is supplied to said air inlet; and control means connected for controlling the supply of compressed air to said air inlet.

2. Apparatus as in claim 1 wherein said distribution means comprises only components which are stationary and motionless with respect to one another during normal operation.

3. Apparatus as in claim 1 wherein said control means includes means for successively turning said supply of air on and then substantially off thereby causing said burner to be supplied with successive impulses of powdered solid fuel.

4. Apparatus as in claim 1 comprising a plurality of said outlets connected to a corresponding plurality of burners and including means for controlling the relative rates at which said powdered solid fuel is blown into individual ones of the outlets.

5. Apparatus as in claim 4 wherein said burners are disposed in a kiln and wherein said distribution means is disposed on top of said kiln.

6. Apparatus as in claim 5 wherein said control means includes means for successively turning said supply of air on and then substantially off thereby causing said burners to be supplied with successive impulses of powdered solid fuel.

7. Apparatus as in claim 6 wherein said air inlet is disposed below said fuel inlet and said outlets are disposed intermediate and laterally displaced from said air and fuel inlets and wherein said stop plate comprises a static structure disposed between said air and fuel inlets for shielding the air inlet from incoming powdered solid fuel and for directing such incoming powdered solid fuel to pass downwardly into an air current flowing from said air inlet to and through said outlets.

8. Apparatus as in claim 7 further comprising:

a storage means mounted above said fuel inlet for containing a supply of said powdered solid fuel and for gravity feeding such supply through said fuel inlet; and means for maintaining at least a predetermined amount of fuel in said storage means sufficient to prevent substantial passage of air through said fuel inlet.

9. Apparatus as in claim 1 wherein said air inlet is disposed below said fuel inlet and said outlet is disposed intermediate and laterally displaced from said air and fuel inlets and wherein said stop plate comprises a static structure disposed between said air and fuel inlets for shielding the air inlet from incoming powdered solid fuel and for directing such incoming powdered solid fuel to pass downwardly into an air current flowing from said air inlet to and through said outlet.

10. Apparatus as in claim 9 wherein said control means includes means for successively turning said supply of air on and then substantially off thereby causing said burner to be supplied with successive impulses of powdered solid fuel.

11. Apparatus as in claim 9 comprising a plurality of said outlets connected to a corresponding plurality of burners and including means for controlling the relative rates at which said powdered solid fuel is blown into individual ones of the outlets.

12. Apparatus as in claim 1 further comprising:

a storage means mounted above said fuel inlet for containing a supply of said powdered solid fuel and for gravity feeding such supply through said fuel inlet; and means for maintaining at least a predetermined amount of fuel in said storage means sufficient to prevent substantial passage of air through said fuel inlet.

13. Apparatus for controlled distribution of powdered solid fuel to a burner, said apparatus comprising:

distribution means having a fuel inlet connected to receive a supply of powdered solid fuel;

said distribution means having an air inlet connected for receiving a supply of compressed air;

said distribution means having an outlet adapted for connection to said burner;

said distribution means, said fuel inlet, said air inlet and said outlet being constructed relative to one another so as to cause the powdered solid fuel entering through the fuel inlet to pass downwardly, through an air current to be positively blown into and through said outlet at a rate dependent upon the rate at which compressed air is supplied to said air inlet;

control means connected for controlling the supply of compressed air to said air inlet;

a storage means mounted above said fuel inlet for containing a supply of said powdered solid fuel and for gravity feeding such supply through said fuel inlet; and means for maintaining at least a predetermined amount of fuel in said storage means sufficient to prevent substantial passage of air through said fuel inlet, wherein said means for maintaining further comprises:

a source for providing compressed air;

a source for providing powdered solid fuel;

pneumatic conveyance means disposed for mixing said compressed air and powdered solid fuel and for conveying said mixture pneumatically;

separation means connected to receive said mixture of compressed air and powdered solid fuel from said pneumatic conveyance means and to separate such mixture into its powdered solid fuel component and its compressed air component; and means for directing the separated air component to said air inlet and for directing the separated powdered solid fuel component into said storage means.

14. Apparatus as in claim 13 comprising a plurality of said outlets connected to a corresponding plurality of burners and including means for controlling the relative rates at which said powdered solid fuel is blown into individual ones of the outlets.

15. Apparatus as in claim 14 wherein said air inlet is disposed below said fuel inlet and said outlet is disposed intermediate and laterally displaced from said air and fuel inlets and wherein said distribution means includes a static structure disposed between said air and fuel inlets for shielding the air inlet from incoming powdered solid fuel and for directing such incoming powdered solid fuel to pass downwardly into an air current flowing from said air inlet to and through said outlet.

16. Apparatus as in claim 15 wherein said means for controlling the relative rates comprises individual valve means connected with each of said outlets and supplied with compressed air for controlling the relative air pressures at individual ones of said outlets thereby controlling the relative amounts of powdered solid fuel conveyed therethrough.

17. Apparatus as in claim 16 further comprising manifold means connected for supplying said individual valve means with compressed air comprising a portion of the separated air component from said separation means.

18. Apparatus as in claim 17 wherein said source for providing powdered solid fuel comprises means for drying and grinding a solid fuel into powdered form.

19. Apparatus as in claim 18 wherein said burners are disposed in a kiln and wherein said means for drying includes means for directing hot gases from said kiln over the solid fuel.

20. Apparatus for controlled distribution of powdered solid fuel to a plurality of burners, said apparatus comprising:

distribution means having a fuel inlet connected to receive a supply of powdered solid fuel;

said distribution means having an air inlet connected for receiving a supply of compressed air;

said distribution means having a plurality of outlets connected to a corresponding plurality of burners;

said burners being disposed in a kiln and wherein said distribution means is disposed on top of said kiln;

means for controlling the relative rates at which said powdered solid fuel is blown into individual ones of the outlets;

said control means having means for successively turning said supply of air on and then substantially off thereby causing said burners to be supplied with successive impulses of powdered solid fuel;

said distribution means, said fuel inlet, said air inlet and said outlets being constructed relative to one another so as to cause the powdered solid fuel entering through the fuel inlet to pass downwardly, through an air current to be positively blown into and through said outlet at a rate dependent upon the rate at which compressed air is supplied to said air inlet;

said air inlet is disposed below said fuel inlet and said outlets are disposed intermediate and laterally displaced from said air and fuel inlets;

said distribution means having a static structure disposed between said air and fuel inlets for shielding the air inlet from incoming powdered solid fuel and for directing such incoming powdered solid fuel to pass downwardly into an air current flowing from said air inlet to and through said outlets;

control means connected for controlling the supply of compressed air to said air inlet;

a storage means mounted above said fuel inlet for containing a supply of said powdered solid fuel and for gravity feeding such supply through said fuel inlet; and means for maintaining at least a predetermined amount of fuel in said storage means sufficient to prevent substantial passage of air through said fuel inlet, wherein said means for maintaining further comprises:

a source for providing compressed air;

a source for providing powdered solid fuel;

pneumatic conveyance means disposed for mixing said compressed air and powdered solid fuel and for conveying said mixture pneumatically;

separation means connected to receive said mixture of compressed air and powdered solid fuel from said pneumatic conveyance means and to separate such mixture into its powdered solid fuel component and its compressed air component; and means for directing the separated air component to said air inlet and for directing the separated powdered solid fuel component into said storage means.

21. Apparatus as in claim 20 wherein said means for controlling the relative rates comprises individual valve means connected with each of said outlets and supplied with compressed air for controlling the relative air pressures at individual ones of said outlets thereby controlling the relative amounts of powdered solid fuel conveyed therethrough.

22. Apparatus as in claim 21 further comprising manifold means connected for supplying said individual valve means with compressed air comprising a portion of the separated air component from said separation means.

23. Apparatus for controlling distribution of powdered solid fuel to a plurality of burners, said apparatus comprising:

distribution means connected to receive a supply of powdered solid fuel from above at a fuel inlet port and having plural outlet ports connected to respectively corresponding ones of said plurality of burners;

said distribution means including a stop plate disposed to intercept said supply of fuel and to cause such intercepted fuel to spill over the stop plate edge into an area including an air space adjacent said outlet ports;

said distribution means also having an air inlet port communicating with all said output ports;

said distribution means being formed of stationary components arranged with respect to said fuel inlet port, said plural outlet ports and said air inlet port so that, when said air inlet port is supplied with compressed air, the received supply of powdered solid fuel spills over the edge of said stop plate into said air space where it mixes with air and is positively blown outwardly through said plural outlet ports;

group control means connected to control the supply of air to said air inlet port thereby controlling the total amount of fuel distributed; and individual control means operatively connected to at least some of the plural outlet ports to control the relative amount of fuel distributed to the individual burners.

24. Apparatus for controlling distribution of powdered solid fuel to a plurality of burners, said apparatus comprising:

distribution means connected to receive a supply of powdered solid fuel at a fuel inlet port and having plural outlet ports connected to respectively corresponding ones of said plurality of burners;

said distribution means also having an air inlet port;

said distribution means being formed of stationary components arranged with respect to said fuel inlet port, said plural outlet ports and said air inlet port so that, when said air inlet port is supplied with compressed air, the received supply of powdered solid fuel is positively blown outwardly through said plural outlet ports;

said distribution means further having an annular housing having said output ports spaced therearound;

said fuel inlet port comprising a central opening on the top side of said distribution means adapted for connection to receive a supply of powdered solid fuel therethrough;

a stop plate of approximately the same dimensions as said central opening registered with and suspended below said central opening at a height intermediate of said output ports such that the powdered solid fuel spills over the edges of the stop plate into the vicinity of said output ports;

said air inlet port comprising an opening in the bottom side of said distribution means adapted for connection to a source of compressed air;

group control means connected to control the supply of air to said air inlet port thereby controlling the total amount of fuel distributed; and individual control means operatively connected to at least some of the plural outlet ports to control the relative amounts of fuel distributed to the individual burners.

25. Apparatus for controlled distribution of powdered solid fuel to a plurality of burners, said apparatus comprising:

distribution means connected to receive a supply of powdered solid fuel at a fuel inlet port and having plural outlet ports connected to respectively corresponding ones of said plurality of burners;

said distribution means also having an air inlet port;

said distribution means being formed of stationary components arranged with respect to said fuel inlet port, said plural outlet ports and said air inlet port so that, when said air inlet port is supplied with compressed air, the received supply of powdered solid fuel is positively blown outwardly through said plural outlet ports;

group control means connected to control the supply of air to said air inlet port thereby controlling the total amount of fuel distributed;

individual control means operatively connected to at least some of the plural outlet ports to control the relative amounts of fuel distributed to the individual burners;

storage means connected and disposed above said fuel inlet port for storing a ready supply of said powdered solid fuel; and supply means for insuring that said storage means always contains sufficient powdered solid fuel to prevent substantial air passage through said fuel inlet port.

26. Apparatus as in claim 25 wherein said supply means comprises:

pneumatic conveyance means fo supplying said powdered solid fuel entrained within a flow of compressed air;

precipitation means connected to receive the output of said pneumatic conveyance means, to separate the powdered solid fuel from the compressed air supplied therewith, to direct the separated powdered solid fuel to said storage means and to direct at least a part of the separated compressed air to said air inlet on the distribution means.

27. Apparatus as in claim 26 wherein said individual control means comprises:

a manifold means supplied with air from the outlet of the precipitation means;

a conduit connected from said manifold means to each of said plural output ports for supplying supplemental compressed air thereto; and individual control valve means in such conduits for individually adjusting the quantity of said supplemental compressed air supplies and thereby controlling the relative amounts of fuel distributed to said individual burners.

28. Apparatus as in claim 26 wherein said supply means further comprises:

supply control means for automatically decreasing or stopping the supply of powdered solid fuel to said pneumatic conveyance means upon detection of a predetermined maximum quantity in said storage means and for automatically increasing or restarting the supply of powdered solid fuel to said pneumatic conveyance means upon detection of a predetermined minimum quantity in said storage means.

29. Apparatus as in claim 28 wherein said group control means comprises:

temperature control means for automatically decreasing or stopping the supply of air to said air inlet upon detection of a predetermined temperature produced by said burners;

said temperature control means including means for first decreasing or stopping the supply of powdered solid fuel to said pneumatic conveyance means before decreasing or stopping the supply of air to the air inlet so as to prevent stoppages from developing in the pneumatic conveyance means due to decreased air flow.

30. Apparatus as in claim 26 wherein said group control means comprises:

temperature control means for automatically decreasing or stopping the supply of air to said air inlet upon detection of a predetermined temperature produced by said burners;

said temperature control means including means for first decreasing or stopping the supply of powdered solid fuel to said pneumatic conveyance means before decreasing or stopping the supply of air to the air inlet so as to prevent stoppages from developing in the pneumatic conveyance means due to decreased air flow.

31. Apparatus as in claim 30 wherein said individual control means comprises:

a manifold means supplied with air from the outlet of the precipitation means;

a conduit connected from said manifold means to each of said plural output ports for supplying supplemental compressed air thereto; and individual control valve means in such conduits for individually adjusting the quantity of said supplemental compressed air supplies and thereby controlling the relative amounts of fuel distributed to said individual burners.

32. Apparatus as in claim 31 wherein said supply means further comprises:

supply control means for automatically decreasing or stopping the supply of powdered solid fuel to said pneumatic conveyance means upon detection of a predetermined maximum quantity in said storage means and for automatically increasing or restarting the supply of powdered solid fuel to said pneumatic conveyance means upon detection of a predetermined minimum quantity in said storage means.

33. Apparatus for controlled distribution of powdered solid fuel to a plurality of burners, said apparatus comprising:

a storage container for storing a supply of powdered solid fuel;

a distributor having a fuel inlet connected to receive powdered solid fuel from said storage container, a stop plate disposed to intercept said fuel and to cause it to spill over the stop plate edges into an area including an air space and a plurality of outlets disposed adjacent said air spaces corresponding to and connected with said plurality of burners for supplying powdered solid fuel thereto;

said distributor also having an air inlet communicating with said outlets and connected to receive a supply of air having a higher relative pressure than the air pressure at the burners;

said distributor being constructed to cause incoming powdered coal from the fuel inlet to pass over the edges of said stop plate into said air spaces where it is mixed with air coming from said air inlet and positively forced by moving air current into said outlets and onward to said burners; and group control means for controlling the supply of air into said air inlet thereby controlling the rate at which fuel is distributed to said plurality of burners taken as a group.

34. Apparatus as in claim 33 wherein said control means includes means for successively turning said supply of air substantially on and then off thereby causing said burners to be supplied with successive impulses of powdered solid fuel.

35. Apparatus as in claim 33 wherein said distributor comprises only components which are stationary and motionless with respect to one another during normal operation.

36. Apparatus as in claim 35 wherein said storage container is provided with an opening at a lower end and the fuel inlet of said distributor is fixedly connected thereto permitting powdered solid fuel to feed by gravity forces thereinto.

37. Apparatus as in claim 33 wherein said storage container is provided with an opening at a lower end and the fuel inlet of said distributor is fixedly connected thereto permitting powdered solid fuel to feed by gravity forces thereinto.

38. Apparatus for controlled distribution of powdered solid fuel to a plurality of burners, said apparatus comprising:

a storage container for storing a supply of powdered solid fuel;

a distributor having a fuel inlet connected to receive powdered solid fuel from said storage container and a plurality of outlets corresponding to and connected with said plurality of burners for supplying powdered solid fuel thereto;

at least one of said plurality of outlets having a supplemental air inlet and an individual control means connected therewith for controlling the amount of air admitted thereinto which, in turn, controls the rate at which fuel is distributed to the particular burner supplied therefrom and thereby providing control over the rate at which fuel is supplied to the total plurality of burners as well as control over the relative rate at which fuel is suppled to desired individual ones of said burners;

said distributor also having an air inlet connected to receive a supply of air having a higher relative pressure than the air pressure at the burners;

said distributor being constructed to cause incoming powdered coal from the fuel inlet to pass directly into air streams coming from said air inlet and passing to the plurality of outlets whereby said powdered fuel is positively forced by moving air into said outlets and onward to said burners; and group control means for controlling the supply of air into said air inlet thereby controlling the rate at which fuel is distributed to said plurality of burners taken as a group.

39. Apparatus as in claim 38 wherein each of said individual control means comprises a manually adjustable valve whereby the relative temperatures of individual ones of said plurality of burners may be adjusted as desired.

40. Apparatus as in claim 38 wherein said distributor comprises only components which are stationary and motionless with respect to one another during normal operation.

41. Apparatus as in claim 40 wherein said storage container is provided with an opening at a lower end and the fuel inlet of said distributor is fixedly connected thereto permitting powdered solid fuel to feed by gravity forces thereinto.

42. Apparatus as in claim 41 wherein:

said distributor includes a stop plate spaced downwardly from said fuel inlet and open about at least a portion of its periphery permitting the gravity fed powdered solid fuel to spill over said periphery;

said plurality of outlets being disposed radially outwardly of said periphery; and said air inlet being disposed beneath said stop plate whereby air from the air inlet positively entrains the powdered solid fuel spilled about said periphery as it passes to said plurality of outlets.

43. Apparatus as in claim 42 wherein said group control means includes:

a manually controlled valve in an air supply conduit connected with said air inlet for adjusting the rate at which fuel is supplied to the total plurality of burners when said apparatus is in operation; and an automatically controllable valve also being provided in series with said manually controlled valve for controlling the air supply to said air inlet thereby maintaining a desired temperature control by controlling the cumulative quantity of fuel distributed to said plurality of burners.

44. Apparatus as in claim 43 wherein the powdered solid fuel is delivered pneumatically with compressed air and further comprising:

a precipitator having an inlet connected for receiving the pneumatically conveyed powdered solid fuel;

said precipitator acting to separate the powdered solid fuel from its air carrier and having a fuel outlet connected to deposit the separated powdered solid fuel into said storage container and an air outlet connected to supply air to said air inlet of the distributor whereby one source of compressed air furnishes air for driving the distributor as well as air for conveying the fuel into the storage container.

45. Apparatus for controlled distribution of powdered solid fuel to a plurality of burners, said apparatus comprising:

a storage container for storing a supply of powdered solid fuel;

a distributor having a fuel inlet connected to receive powdered solid fuel from said storage container and a plurality of outlets corresponding to and connected with said plurality of burners for supplying powdered solid fuel thereto;

said storage container having an opening at a lower end and the fuel inlet of said distributor is fixedly connected thereto permitting powdered solid fuel to feed by gravity forces thereinto;

said distributor also having an air inlet connected to receive a supply of air having a higher relative pressure than the air pressure at the burners;

said distributor being constructed to cause incoming powdered coal from the fuel inlet to pass directly into air streams coming from said air inlet and passing to the plurality of outlets whereby said powdered fuel is positively forced by moving air into said outlets and onward to said burners;

said distributor includes a stop plate spaced downwardly from said fuel inlet and open about at least a portion of its periphery permitting the gravity fed powdered fuel to spill over said periphery;

said plurality of outlets being disposed radially outwardly of said periphery;

said air inlet being disposed beneath said stop plate whereby air from the air inlet positively entrains the powdered fuel spilled about said periphery as it passes to said plurality of outlets; and group control means for controlling the supply of air into said air inlet thereby controlling the rate at which fuel is distributed to said plurality of burners taken as a group.

46. Apparatus as in claim 45 wherein said group control means includes:

a manually controlled valve in an air supply conduit connected with said air inlet for adjusting the rate at which fuel is supplied to the total plurality of burners when said apparatus is in operation; and an automatically controllable valve also being provided in series with said manually controlled valve for controlling the air supply to said air inlet thereby maintaining a desired temperature control by controlling the cumulative quantity of fuel distributed to said plurality of burners.

47. Apparatus as in claim 46 wherein the powdered solid fuel is delivered pneumatically with compressed air and further comprising:

a precipitator having an inlet connected for receiving the pneumatically conveyed powdered solid fuel;

said precipitator acting to separate the powdered solid fuel from its air carrier and having a fuel outlet connected to deposit the separated powdered solid fuel into said storage container and an air outlet connected to supply air to said air inlet of the distributor whereby one source of compressed air furnishes air for driving the distributor as well as air for conveying the fuel into the storage container.

48. Apparatus as in claim 47 wherein at least one of said plurality of outlets includes a supplemental air inlet and an individual control means connected therewith for controlling the amount of air admitted thereinto which, in turn, controls the rate at which fuel is distributed to the particular burner supplied therefrom and thereby providing control over the rate at which fuel is supplied to the total plurality of burners as well as control over the relative rate at which fuel is supplied to desired individual ones of said burners.

49. Apparatus as in claim 48 further comprising a manifold connected to supply said supplemental air inlets with air from said air outlet of the precipitator.

50. Apparatus as in claim 49 wherein each of said individual control means comprises a manually adjustable valve whereby the relative temperatures of individual ones of said plurality of burners may be adjusted as desired.

51. Apparatus for controlled distribution of powdered solid fuel to a plurality of burners, said apparatus comprising:

a storage container for storing a supply of powdered solid fuel;

a distributor having a fuel inlet connected to receive powdered solid fuel from said storage container and a plurality of outlets corresponding to and connected with said plurality of burners for supplying powdered solid fuel thereto;

said distributor also having an air inlet connected to receive a supply of air having a higher relative pressure than the air pressure at the burners;

said distributor being constructed to cause incoming powdered coal from the fuel inlet to pass directly into air streams coming from said air inlet and passing to the plurality of outlets whereby said powdered fuel is positively forced by moving air into said outlets and onward to said burners;

group control means for controlling the supply of air into said air inlet thereby controlling the rate at which fuel is distributed to said plurality of burners taken as a group;

said control means having a manually controlled valve in an air supply conduit connected with said air inlet for adjusting the rate at which fuel is supplied to the total plurality of burners when said apparatus is in operation; and said control means having an automatically controllable valve also being provided in series with said manually controlled valve for controlling the air supply to said air inlet thereby maintaining a desired temperature by controlling the cumulative quantity of fuel distributed to said plurality of burners.

52. Apparatus as in claim 51 wherein the powdered solid fuel is delivered pneumatically with compressed air and further comprising:

a precipitator having an inlet connected for receiving the pneumatically conveyed powdered solid fuel;

a precipitator acting to separate the powdered solid fuel from its air carrier and having a fuel outlet connected to deposit the separated powdered solid fuel into said storage container and an air outlet connected to supply air to said air inlet of the distributor whereby one source of compressed air furnishes air for driving the distributor as well as air for conveying the fuel into the storage container.

53. Apparatus as in claim 52 wherein at least one of said plurality of outlets includes a supplemental air inlet and an individual control means connected therewith for controlling the amount of air admitted thereinto which, in turn, controls the rate at which fuel is distributed to the particular burner supplied therefrom and thereby providing control over the rate at which fuel is supplied to the total plurality of burners as well as control over the relative rate at which fuel is supplied to desired individual ones of said burners.

54. Apparatus as in claim 53 wherein each of said individual control means comprises a manually adjustable valve whereby the relative temperatures of individual ones of said plurality of burners may be adjusted as desired.

55. Apparatus for controlled distribution of powdered solid fuel to a plurality of burners, said apparatus comprising:

a storage container for storing a supply of powdered solid fuel;

a distributor having a fuel inlet connected to receive powdered solid fuel from said storage container and a plurality of outlets corresponding to and connected with said plurality of burners for supplying powdered solid fuel thereto;

said distributor also having an air inlet connected to receive a supply of air having a higher relative pressure pressure than the air pressure at the burners;

said distributor being constructed to cause incoming powdered coal from the fuel inlet to pass directly into air streams coming from said air inlet and passing to the plurality of outlets whereby said powdered fuel is positively forced by moving air into said outlets and onward to said burners;

group control means for controlling the supply of air into said air inlet thereby controlling the rate at which fuel is distributed to said plurality of burners taken as a group;

said powdered solid fuel being delivered pneumatically with compressed air;

a precipitator having an inlet connected for receiving the pneumatically conveyed powdered solid fuel; and said precipitator acting to separate the powdered solid fuel from its air carrier and having a fuel outlet connected to deposit the separated powdered solid fuel into said storage container and an air outlet connected to supply air to said air inlet of the distributor whereby one source of compressed air furnishes air for driving the distributor as well as air for conveying the fuel into the storage container.

56. Apparatus as in claim 55 wherein at least one of said plurality of outlets includes a supplemental air inlet and an individual control means connected therewith for controlling the amount of air admitted thereinto which, in turn, controls the rate at which fuel is distributed to the particular burner supplied therefrom and thereby providing control over the rate at which fuel is supplied to the total plurality of burners as well as control over the relative rate at which fuel is supplied to desired individual ones of said burners.

57. Apparatus as in claim 56 further comprising a manifold connected to supply said supplemental air inlets with air from said air outlet of the precipitator.

58. Apparatus as in claim 57 wherein each of said individual control means comprises a manually adjustable valve whereby the relative temperatures of individual ones of said plurality of burners may be adjusted as desired.

59. Apparatus for controlled distribution of powdered solid fuel to a plurality of burners, said apparatus comprising:

a storage container for storing a supply of powdered solid fuel;

a distributor having a fuel inlet connected to receive powdered solid fuel from said storage container and a plurality of outlets corresponding to and connected with said plurality of burners for supplying powdered solid fuel thereto;

said storage container having an opening at a lower end and the fuel inlet of said distributor being fixedly connected thereto permitting powdered solid fuel to feed by gravity forces thereinto;

said distributor also having an air inlet connected to receive a supply of air having a higher relative pressure than the air pressure at the burners;

said distributor being constructed to cause incoming powdered coal from the fuel inlet to pass directly into air streams coming from said air inlet and passing to the plurality of outlets whereby said powdered fuel is positively forced by moving air into said outlets and onward to said burners;

said distributor having a stop plate spaced downwardly from said fuel inlet and open about at least a portion of its periphery permitting the gravity fed powdered solid fuel to spill over said periphery;

said plurality of outlets being disposed radially outwardly of said periphery;

said air inlet being disposed beneath said stop plate whereby air from the air inlet positively entrains the powdered solid fuel spilled about said periphery as it passes to said plurality of outlets;

said distributor having only components which are stationary and motionless with respect to one another during normal operation; and group control means for controlling the supply of air into said air inlet thereby controlling the rate at which fuel is distributed to said plurality of burners taken as a group.

60. Apparatus as in claim 59 wherein said group control means includes:

a manually controlled valve in an air supply conduit connected with said air inlet for adjusting the rate at which fuel is supplied to the total plurality of burners when said apparatus is in operation; and an automatically controllable valve also being provided in series with said manually controlled valve for controlling the air supply to said air inlet thereby maintaining a desired temperature control by controlling the cumulative quantity of fuel distributed to said plurality of burners.

61. Apparatus as in claim 60 wherein the powdered solid fuel is delivered pneumatically with compressed air and further comprising:

a precipitator having an inlet connected for receiving the pneumatically conveyed powdered solid fuel;

said precipitator acting to separate the powdered solid fuel from its air carrier and having a fuel outlet connected to deposit the separated powdered solid fuel into said storage container and an air outlet connected to supply air to said air inlet of the distributor whereby one source of compressed air furnishes air for driving the distributor as well as air for conveying the fuel into the storage container.

62. Apparatus as in claim 61 wherein at least one of said plurality of outlets includes a supplemental air inlet and an individual control means connected therewith for controlling the amount of air admitted thereinto which, in turn, controls the rate at which fuel is distributed to the particular burner supplied therefrom and thereby providing control over the rate at which fuel is supplied to the total plurality of burners as well as control over the relative rate at which fuel is supplied to desired individual ones of said burners.

63. Apparatus as in claim 62 further comprising a manifold connected to supply said supplemental air inlets with air from said air outlet of the precipitator.

64. Apparatus as in claim 63 wherein each of said individual control means comprises a manually adjustable valve whereby the relative temperatures of individual ones of said plurality of burners may be adjusted as desired.

65. Method for controlled distribution of powdered solid fuel to a plurality of burners, said method comprising the steps of:

accumulating a supply of powdered solid fuel in a storage container;

gravity feeding said powdered solid fuel from said storage container downwardly over the edges of a stop plate and directly into air spaces where the fuel is mixed with air and conveyed along the paths of plural air streams moving towards and through corresponding said air spaces and plural outlet openings connected to supply respectively corresponding ones of said burners; and controlling the timing and rate at which air is supplied to said air streams and thereby controlling the times and rate at which powdered solid fuel is distributed to said burners.

66. Method as in claim 65 wherein said controlling step comprises:

controlling the overall rate at which air is supplied to said air streams taken as a group and thereby controlling the overall rate at which fuel is supplied to said plurality of burners taken as a group.

67. Method as in claim 65 wherein said controlling step comprises:

controlling the relative rates at which air is supplied to individual ones of said air stream and thereby controlling the relative rates at which fuel is supplied to corresponding individual ones of said burners.

68. Method as in claim 67 wherein said controlling step further comprises:

controlling the overall rate at which air is supplied to said air streams taken as a group and thereby controlling the overall rate at which fuel is supplied to said plurality of burners taken as a group.

69. Method as in claim 68 wherein said controlling step comprises successively turning the supply of air to said air streams on and then substantially off thereby causing said burners to be supplied with successive impulses of powdered solid fuel.

70. Method as in claim 65 wherein said controlling step comprises successively turning the supply of air to said air streams on and then substantially off thereby causing said burners to be supplied with successive impulses of powdered solid fuel.

71. Method as in claim 65 wherein:

1 said accumulating step comprises pneumatically conveying said powdered solid fuel through a conduit with an air current and then separating the air from the powdered fuel and feeding the separated powdered fuel into said storage container;

said method also comprising the step of collecting and directing said separated air so as to supply said air streams thereby requiring only a single source of air for both pneumatic conveyance of the fuel into the storage container and the distribution of such fuel to the individual burners.

72. Method as in claim 71 wherein said controlling step comprises:

controlling the overall rate at which air is supplied to said air streams taken as a group and thereby controlling the overall rate at which fuel is supplied to said plurality of burners taken as a group.

73. Method as in claim 71 wherein said controlling step comprises:

controlling the relative rates at which air is supplied to individual ones of said air streams and thereby controlling the relative rates at which fuel is supplied to corresponding individual ones of said burners.

74. Method as in claim 73 wherein said controlling step further comprises:

controlling the overall rate at which air is supplied to said air streams taken as a group and thereby controlling the overall rate at which fuel is supplied to said plurality of burners taken as a group.

75. Method as in claim 65 wherein said accumulating step comprises maintaining at least a predetermined amount of powdered solid fuel in said storage container sufficient to prevent substantial passage of air between the inlet and outlet of said storage container.

* * * * *